US005772016A

United States Patent [19]

Akerlind

[11] Patent Number: 5,772,016

[45] Date of Patent: Jun. 30, 1998

[54] PACKAGE FOR A LIQUID AND A SUBSTANCE

[75] Inventor: Jan Akerlind, Stockholm, Sweden

[73] Assignee: CD Food Technology AB, Stockholm, Sweden

[21] Appl. No.: 722,177

[22] PCT Filed: Apr. 11, 1994

[86] PCT No.: PCT/SE94/00318

§ 371 Date: Oct. 10, 1996

§ 102(e) Date: Oct. 10, 1996

[87] PCT Pub. No.: WO95/27667

PCT Pub. Date: Oct. 19, 1995

[51] Int. Cl.[6] ..... B65D 81/32

[52] U.S. Cl. ..... 206/221; 206/219; 426/113; 426/118; 426/120

[58] Field of Search ..... 206/0.5, 217, 219, 206/221; 426/112, 113, 115, 118, 120, 394, 407

[56] References Cited

U.S. PATENT DOCUMENTS

| | | | |
|---|---|---|---|
| 3,293,048 | 12/1966 | Kitterman . | |
| 4,167,899 | 9/1979 | McCormick | 426/112 |
| 4,399,158 | 8/1983 | Bardsley et al. . | |
| 4,832,968 | 5/1989 | Byrne et al. . | |
| 5,075,119 | 12/1991 | Mendenhall | 426/118 |
| 5,456,929 | 10/1995 | Mifune et al. | 206/219 |

FOREIGN PATENT DOCUMENTS

| | | |
|---|---|---|
| 24 56 209 | 8/1976 | Germany . |
| 91/14637 | 10/1991 | WIPO . |

*Primary Examiner*—Jimmy G. Foster
*Attorney, Agent, or Firm*—Nixon & Vanderhye P.C.

[57] ABSTRACT

A package, comprising a container (1) which contains a liquid (2) and a substance (8), such as a flavourant or nutrient additive, enclosed in an openable capsule (4) or the like, which substance is intended to be mixed with the liquid, where the liquid is intended to be heated in the package, prior to use, and wherein the capsule is liquid tight sealed by means of a temperature dependent bonding agent (10) which is active at temperatures up to a value, in applicable cases, slightly below the temperature to which the container contents are intended to be heated prior to being served. The package is characterized particularly in that the capsule (4) comprises two separate portions (5, 6) which are joined to each other along a continuous joining line by means of the temperature dependent bonding agent (10) and which are so arranged and disposed in the container (1) that they become mutually displaced and separated entirely, as the bonding agent has been made inactive by heating.

20 Claims, 4 Drawing Sheets

PACKAGE FOR A LIQUID AND A SUBSTANCE

The present invention relates to a package comprising a container which contains a liquid and a substance enclosed in an openable capsule or the like, which substance is intended to be mixed with the liquid.

The invention has a plurality of different applications but in as much as it has been conceived in connection with certain works with the design of a package which, in professional connections, permits a rapid and efficient preparation of a hot beverage, particularly coffee or tea, of a higher and more even quality than previously, and to an acceptable total cost, the invention will be disclosed hereinafter initially with reference in particular to preparation of coffee or tea on board aircraft and vehicles by mixing hot water and coffee or tea-powder, respectively, of instant type.

A package of the type as defined in the outset for a beverage comprising a liquid, preferably water, and a flavourant or nutrient additive, and intended to be heated prior to being served is previously known. This known package is characterized in that the flavourant or nutrient additive is enclosed in a known manner in an openable, watertight capsule or the like which is sealed by means of a temperature dependent substance which is active at temperatures up to a value immediately below the temperature to which the container contents are intended to be heated prior to being served, and in that the capsule is manufactured as a one piece unit from a shape-durable material and comprises parts which are mutually connected along a hinge means, and in that the capsule includes means that strive to separate the two pats, which are mutually joined in a watertight fashion by means of a respective sealing surface between which the temperature-dependent sealing substance is disposed. In the patent it has been noted that it is preferred that the capsule contains a resilient means which is intended to facilitate opening of the capsule, and further it is noted as preferred that the capsule material has a density greater than 1. Beyond that the capsule is complicated and expensive in manufacture, it is intended to flow freely in the liquid. This means that the capsule may open itself upwardly, so that an essential proportion of the substance never comes to be mixed with the liquid.

As compared to prior art technique, where a beverage is intended to be prepared by dipping a small container, that houses a concentrated food-stuff product, into liquid which is then heated up to 60°–100° C., at which temperature an opening into the container may be formed, e.g. in that a portion of the container wall melts, a package as defined in the outset offers inter alias the very essential advantage that the liquid and the said substance may in advance be adapted in such a manner that the combination should be the best possible from a taste point of view. Further, with the same object in view, the temperature at which the substance is made available to the liquid may be adapted to the liquid and the substance.

The prior art package as disclosed in the outset has, in a plurality of tests, been found to meet the intended demands comparatively well, viz. to permit a fast and efficient preparation of a hot beverage of a higher and more even quality than before, and to an acceptable total cost.

However, it has been found possible to achieve further improvements, both with respect to a simplified and less expensive production and with respect to a reliable function in practise.

Accordingly, the object of the present invention has been to provide a package which is reliable and which comparatively easily may be adapted to existing production techniques.

Thus, the present invention relates to a package of the kind as defined in the introductory portion of claim 1 below. The package is characterized essentially by that which is defined in the characterizing clause of the said claim.

The invention is disclosed in more details below with reference had to the accompanying drawings .

FIG. 1 shows a container 1 for a liquid 2, made of cardboard and provided with a thin, liquid impermeable layer, not shown, on the inner surface of the container.

Figure 1:
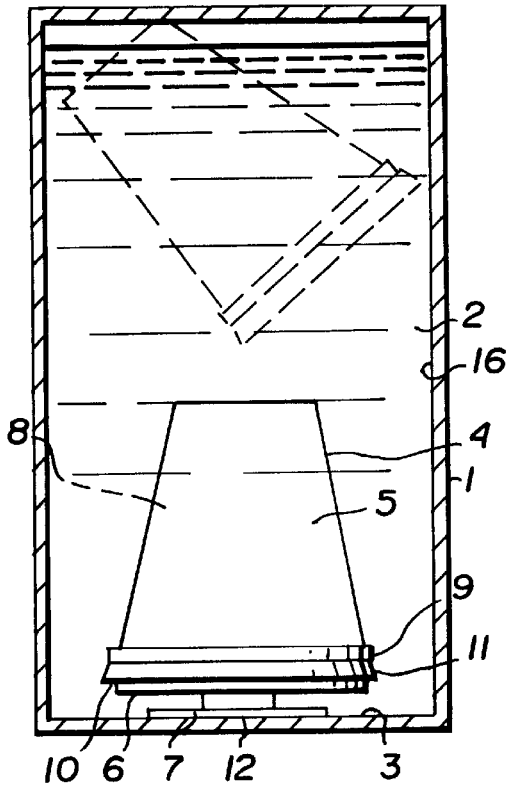
FIG. 1 is a side view, partly in section, of a first embodiment of a package according to the invention.

To the bottom 3 of the container 1 there is affixed a capsule 4. The capsule comprises a bowl-shaped upper portion 5 which is sealingly joined to a disc-shaped lower portion 6 that is carried by a low foot 7. The capsule is shown upside down in FIG. 2. The portion 5 which in this case is filled with coffee powder 8 of so called instant type, has an outer annular flange 9 into which an edge of the lower portion 6 protrudes. The two portions are joined together by means of a bonding agent in the shape of a melt glue 10 which melts at a temperature of 80° C., in an applicable case, and which has been molten in into the annular groove 11 that is formed by the edge of the lowermost portion 6 and the flange 9. On the foot 7 there has been applied a melt glue 12 having a softening temperature of more than 100° C., and the foot is intended to be pressed tightly against the bottom 3 or the container 1 before the glue has set. Here, the capsule 4 is designed to assume the position as shown in FIG. 1, surrounded by the liquid 2, which in the instant case is water.

When the water 2 has been heated up to 80° C. in an applicable case, e.g. in that the container 1 has been placed with the bottom 3 on a cooking plate, the melt glue 10 starts to soften, and, due to the super pressure that arises within the capsule 4 at the heating of the air which is trapped within the capsule, together with the lifting force of the uppermost portion 5 that has a density lower than that of the liquid, the uppermost portion is pushed off from the lowermost portion with a strong blow, while air and coffee powder is expelled from the capsule during an ascending movement of the uppermost portion 5 through the water 2 whereas a further quantity of coffee powder from the inner space within the uppermost portion sinks out from the uppermost portion and mixes with the water. The uppermost portion 5 is dimensioned in such a manner in relation to the width of the container 1, that the uppermost portion 5 cannot tilt more than has been shown, as an example, with dashed lines in FIG. 1. In this way it is prevented that the uppermost portion 5 remains floating in the container 1 with its opening facing upwardly and with coffee powder remaining at the bottom of the uppermost portion 5.

Figure 2:
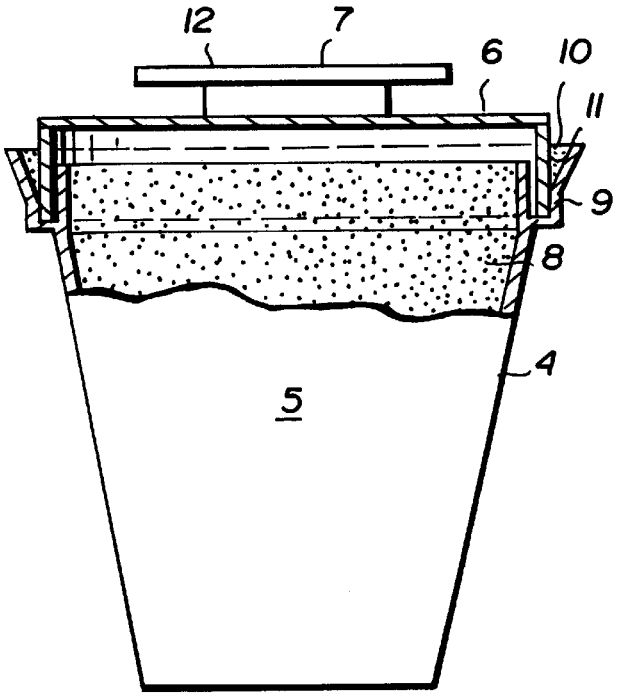
FIG. 2 is a longitudinal section of one embodiment of a capsule according to FIG. 1 during manufacture.
Figure 3:
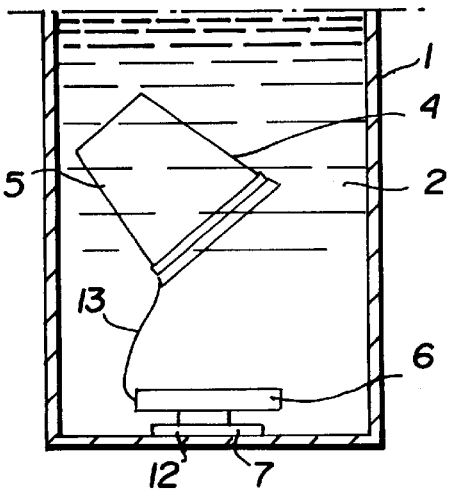
FIG. 3 is a partial section of a second embodiment of a capsule according to the invention.

FIG. 3 shows another embodiment of the capsule which here comprises an uppermost portion 5 which is smaller than the one as shown in FIG. 1 and which, in this case, is made from a material that is lighter than water. When the uppermost portion 5 is freed from the lowermost portion 6 in the above disclosed way it may tilt, but it is locked up by means of an anchoring, such as a thread 13 which has one end affixed to the edge of the uppermost portion 5 and has its other end affixed to the edge of the lowermost potion 6. Therefore, the uppermost portion 5 will assume the the position as shown, where all of the coffee powder will be most reliable flushed ting the bottom of the container. Further, the uppermost portion is designed to flow upwardly, after release thereof, by which flowing the tilting thereof in one or the other direction is limited to a predetermined angle, either in that the dimensions of the uppermost portion are adapted in such a manner in relation to the internal dimensions of the package that the uppermost portion can tilt only an angle less than the predetermined one or in that the uppermost portion is provided with means such as an easily flexible anchoring or a weight that permits a tilting to the predetermined angle 90° and then holds the uppermost portion in that position. Due to this the contents of the uppermost portion will be effectively flushed out from the uppermost portion into the liquid.

Figure 5:
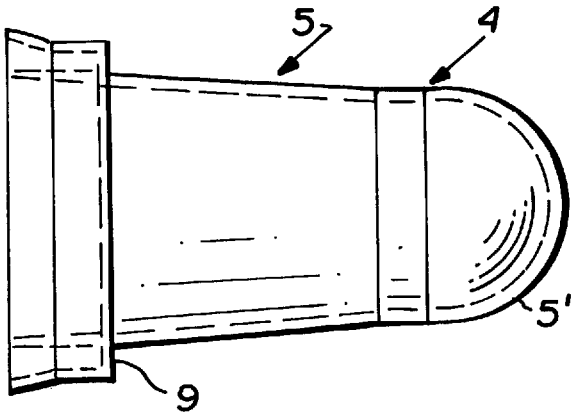
FIG. 5 shows a side view of an uppermost portion of a fourth embodiment of the capsule according to the invention.
Figure 6:
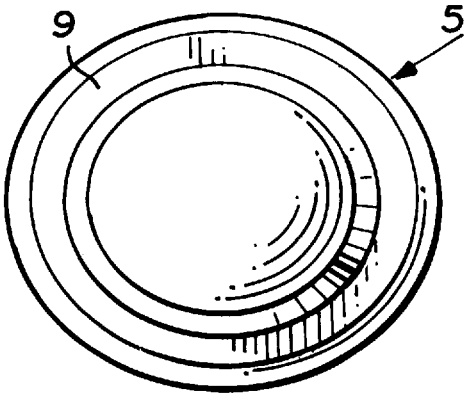
FIG. 6 shows the portion according to FIG. 5, as seen from the right hand end in FIG. 5.
Figure 7:
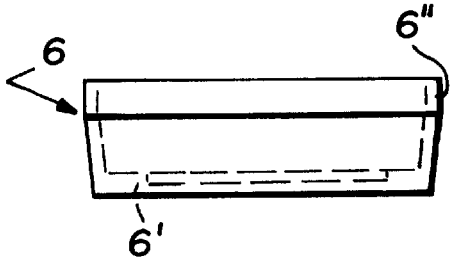
FIG. 7 shows a side view of a lowermost portion for the uppermost portion in FIG. 5 or 6.
Figure 8:
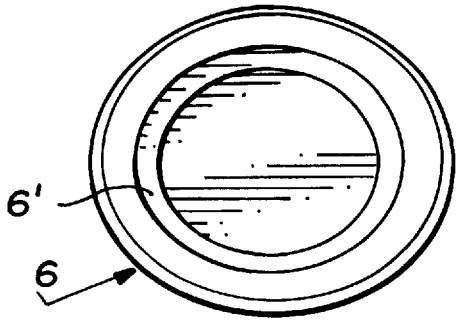
FIG. 8 shows the lowermost portion according to FIG. 7 as seen from below in FIG. 7.

The embodiment according to FIGS. 5–8 is essentially of the same kind as the one as is shown in FIG. 5. However, in this case the upper part 5' of the uppermost portion 5 has a doomed surface, both internally and externally. The lowermost portion 6 is adapted to be affixed to the bottom 3 of the container, without any foot, and has an annular groove 6'. The reference 6" denotes the edge of the lowermost portion, which is adapted to protrude into the groove in order to form, together with the flange 9, a groove 11 which is adapted to receive the bonding agent.

Figure 10:
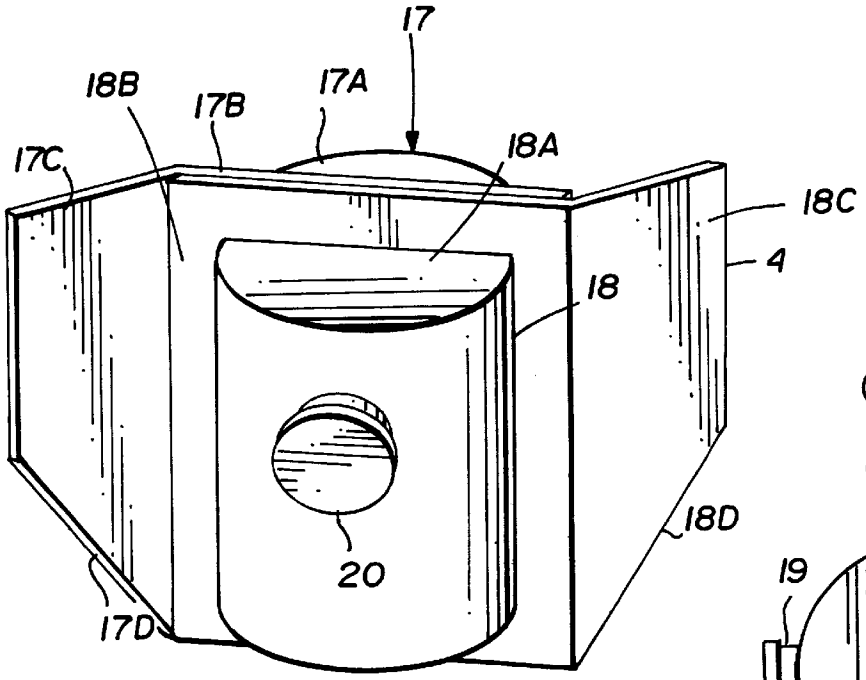
FIG. 10 shows an embodiment of a capsule which forms a part of the package in FIG. 9.

In FIG. 10 there is shown a container l, corresponding to the one as shown in FIG. 1, containing water 2 and a capsule 4 of plastics, containing a given quantity of a flavourant or a nutrient additive 8, such as coffee powder a of instant type.

Figure 11:
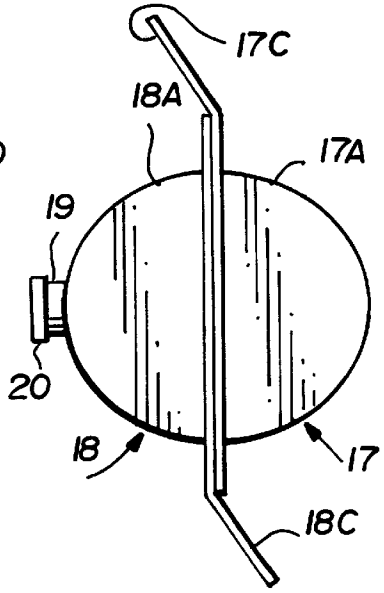
FIG. 11 shows the capsule in FIG. 10 in a top plan view.

As is shown in FIGS. 10 and 11 the capsule 4 is manufactured as two initially separate parts, generally denoted 17, 18. In the embodiment shown each part 17, 18 comprises a part cylindrical tray 17A, 18A which at the free edges all around are surrounded by four rim flanges 17B, 18B, viz. two side rim flanges along the edges of the tray, parallel to the tray axis, and two end rim flanges at the end of the part cylindrical tray. The four rim flanges 173, 133, respectively, of each one of the trays are all disposed in one and the same plane.

The side rim flanges of each one of the trays is extended outwardly from the tray to form a protruding wing 17*c*, 18*c* which preferably forms an angle of e.g. 30° with the common plane of the rim flanges. One end edge 17D, 18D of the respective wings, which will be disposed closest to the bottom 3 of the container by the application of the capsule 4 in the container 1 is preferably cut somewhat obliquely or rounded in order to facilitate the introduction of the capsule into the container 1.

The rim flanges of the two trays are liquid tight sealed together by means of a bonding agent 10 of a kind which softens and looses the ability to keep the parts 17, 18 together at a predetermined temperature, e.g. of the order 60°–70° C.

One capsule portion 18 is provided with a filling opening 19 which in the embodiment shown, subsequent to the filling of the capsule, has been provided with a sealing lid 20.

In the case of e.g. coffee the contents of the package are intended to be heated to a temperature of 80–90° C. prior to serving. As has been mentioned before the bonding agent looses its ability to keep the portions 17, 18 together at a temperature of the order of 60°–70° C., and, thus, at this temperature the capsule 4 opens so that the water comes into contact with the coffee powder, and the coffee powder mixes with the water.

Figure 9:
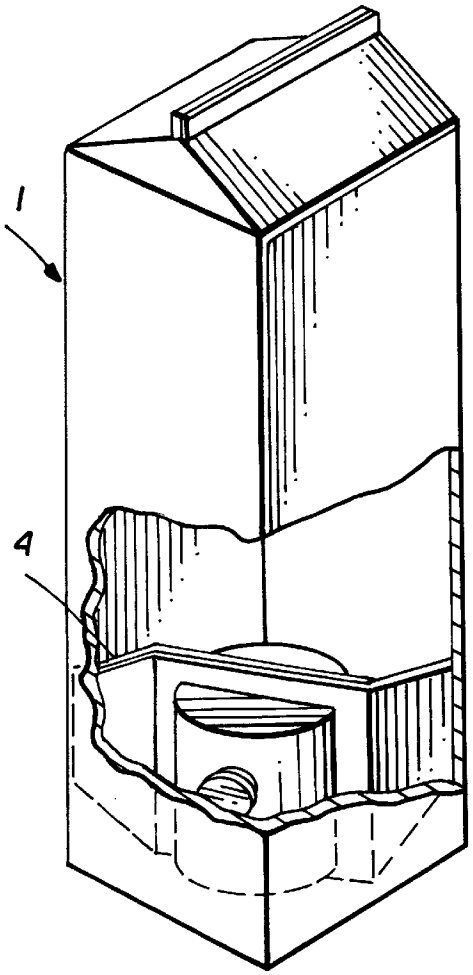
FIG. 9 shows in perspective and partly in section a fifth embodiment of a package according to the present invention.
Figure 12:
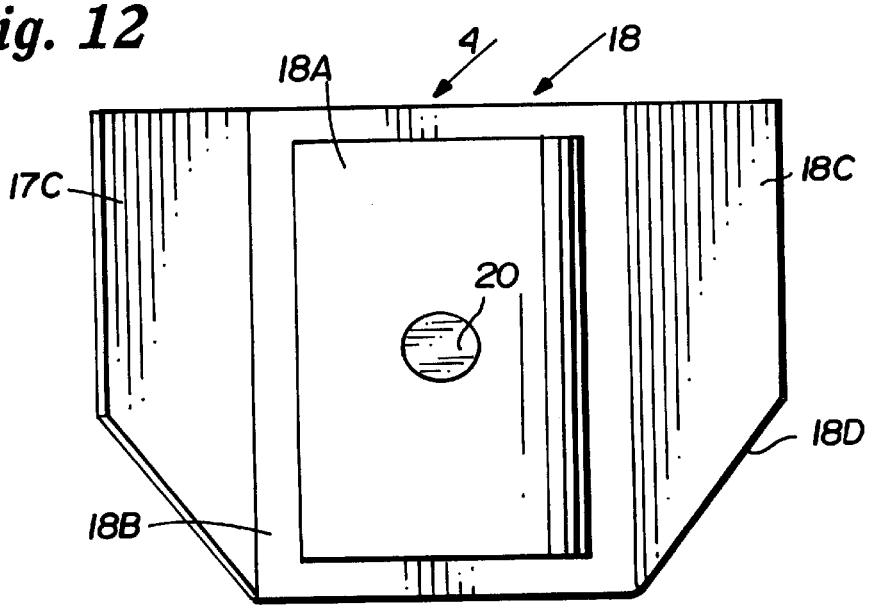
FIG. 12 is a front elevational view of the capsule in FIG. 10.
Figure 13:
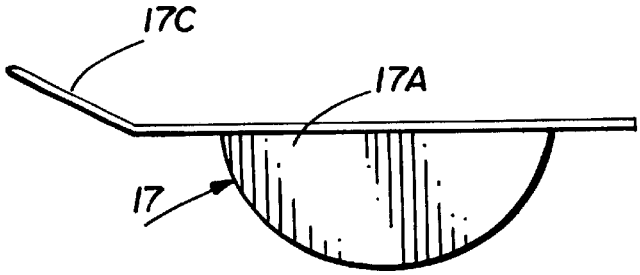
FIG. 13 shows a portion of the capsule in FIG. 10 in end view.
Figure 14:
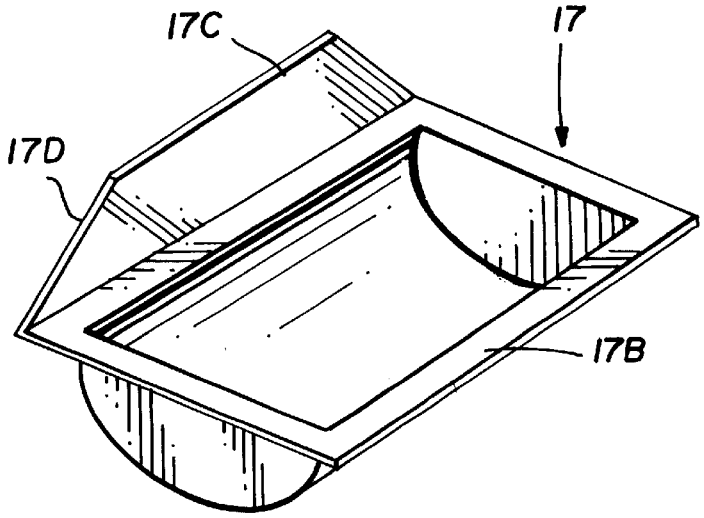
FIG. 14 shows the capsule portion in FIG. 13 in a perspective view.

As is shown in FIG. 9 the capsule 4 with its contents is inserted into the lowermost portion of the container 1, and the dimensions of the capsule 4 are chosen in, such a manner that the capsule initially has the outer edges of the wings 17, 18 therefore resting against two mutually opposite inner corners within the container under at least some bias.

Due to the just mentioned bias as well as due to the fact that the capsule besides the coffee powder also contains a certain quantity of air, which expands at the heating of the capsule, the two capsule portions 17, 18 will be mutually displaced, as the predetermined temperature is attained, and will be separated very instantaneously, like an explosion, so that a very intimate mixing of coffee powder and the water is ensured. This mixing is also sustained by the circumstance that the density of the capsule portions is preferably lower than 1, for which reason they will float upwardly and sustain the mixing, as the capsule portions are released from each other.

The capsule may be designed in a way different from the one as shown, e.g. in that one of the capsule portions is simply formed by a flat disc or foil, which as a lid tightly seals off a tray-shaped portion, similar to the capsule portion 17, in which case the tray-shaped capsule portion and the lid thereof naturally are dimensioned so, that the above described holding of the capsule under a certain bias is ensured.

It should be mentioned that the capsule portions are preferably manufactured by injection moulding of plastics in a pre-heated tool, whereby a certain "memory function" with respect to the outer shape of the portions is achieved.

Depending on the actual field of use the plastic material as used for the capsule 4 should, in most cases, be both liquid and gas diffusion tight, and this more particularly for a storing time of in any case 6 months. A suitable plastic material is the one that is sold by Neste Oy Chemicals, Finland, under the name "Neste Polypropylene VC 35 76ENA" which material meets the requirements according to the present invention and meets the requirements with respect to products as articles or components of articles for use in contact with food—stuffs, as has been described e.g. in Sweden in "Norm-pack (1981)" and in EEC in "Commission Directives 90/128/EEC (1910) and 92/39/EEC (1992), Section A".

The bonding agent, the melt glue, which is used for a tight joining of the capsule portions, is preferably the glue which is sold by Eastman Chemical Int AG/3L HOTMELT AB, HELSINGGBORG, under the name "EASTBOND A-721/A-761", which material is FDA-approved under "United States federal food additive regulations".

The function of the package according to the invention should be essentially clear from the description above. Thus, the capsule of the package comprises two individual portions 5, 6, 17, 18 which are joined to each other by means of the temperature dependent bonding agent along an uninterrupted joint plane and which are arranged in such a manner and are located in such a manner in the container 1, preferably adjacent to the bottom 3 of the container, that they become mutually displaced and are separated entirely as the bonding agent has been made inoperative by the heating thereof. In the embodiment shown, and as preferred, it is intended that there on the said displacement should form an opening portion towards the bottom of the container, above which opening portion an essential proportion of the substance, the additive, and preferably all of it, is disposed. In the embodiment according to FIG. 1–7 the said opening portion is formed by the opening of the uppermost portion 5, and in the embodiment as shown in FIG. 8–13 the said opening portion is formed by the opening as formed between the lowermost end rim flanges 17B, 18B.

As noted above a package according to the invention offers important advantages, both with respect to the manufacture and with respect to the function, as compared to what has been known previously.

The invention has been described above with reference to preferred embodiments. Naturally, further embodiments and the inventive idea.

Figure 4:
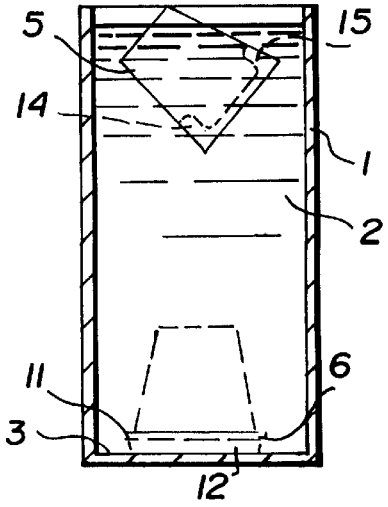
FIG. 4 is a longitudinal section through a third embodiment of a package according to the invention.

Thus, the package according to FIGS. 1–7 is not restricted to only the embodiments as shown and described above but may be further modified in a plurality of ways within the scope of the inventive idea as defined in the claims. In particular , the shape of the capsule 4 may be varied extensively with respect to a.o. the requirement for a simple and inexpensive manufacture. Particularly, by the embodiments as shown in FIGS. 3 and 4, the uppermost portion 5, for instance, may have a different shape, e.g. more or less semi-sferical. Also other temperature ranges for the two bonding agents, the glues 10, 12, would be possible, as well as other types of bonding agents.

Thus, the capsule according to FIGS. 1–7 may be designed in such a manner that the main portion of the volume is disposed in the uppermost portion, which may then easily be filled and sealed to the lowermost portion, that may then be pressed to the bottom of the container to be joined therewith by means of a temperature resistant glue, so that the temperature resistant sealing agent between the uppermost and lowermost portions becomes situated at a given distance from the bottom, surrounded by the liquid without being subjected to possible over temperatures, if the liquid is intended to be heated by heating the bottom of the package. Further, the uppermost portion is adapted to flow upwardly, having been released from the lowermost portion, in which case its tilting in one or the other direction is limited to a given angle, preferably 90°, as a maximum, either in that the dimensions of the uppermost portion are so adapted to the inner dimensions of the package, that the uppermost portion can tilt only an angle less than the just mentioned angle 90°, or in that the uppermost portion is provided with means, an easily flexible anchoring or a weight, which permits tilting to the just mentioned angle of 90° and then maintains the uppermost portion in this position. Due to this the contents of the uppermost portion are effectively flushed out from the uppermost portion, into the liquid.

I claim:

1. A package for a liquid and a substance which is to be mixed with the liquid prior to use, comprising:

a container for the liquid, said container having a bottom and a top;

an openable capsule containing the substance and situated in said container, said capsule having a first separate portion, and a second separate portion which is fixed to the container adjacent said bottom of said container;

a temperature dependent bonding agent joining said first and second separate portions together to form said capsule in a closed state, said bonding agent effecting bonding at temperatures below a predetermined temperature, and terminating bonding at said predetermined temperature to allow said separate portions to separate completely from each other, as the contents of the container are heated to at least said predetermined temperature; and said first separate portion of the capsule having a specific gravity less than that of the liquid so as to float upwardly toward said container top after separation of said first and second portions as a result heating of said bonding agent to at least said predetermined temperature.

2. The package of claim 1 wherein aid first portion of said capsule contains at least a major portion of the substance.

3. The package of claim 1 wherein said first portion of said capsule is in a fixed position relative to said container when joined to said second portion of said capsule, and is joined by said bonding agent to said second portion so as to tilt laterally a limited angle relative to said fixed position, as said first portion floats upwardly after separating from said second portion of said capsule.

4. The package of claim 3 wherein said capsule first portion has a height dimension extending generally between said bottom and said top of said container when in said fixed position, and wherein said container has a width dimension extending generally transverse to a dimension between said top and said bottom of said container; and wherein said height of said first separate portion exceeds said width of said container.

5. The package of claim 4 wherein said height of said first separate portion of said capsule exceeds said width of said container in a manner such that said first separate portion is able to tilt less than 90° relative to said fixed position, as said first separate portion floats upwardly after separation from said second separate portion of said capsule.

6. The package of claim 3 wherein said first portion of said capsule includes a weight causing said first portion to tilt, as said first portion floats upwardly after separation from said second separate portion of said capsule.

7. The package of claim 1 wherein said substance comprises a flavorant or a nutrient.

8. The package of claim 2 wherein said substance comprises a flavorant or a nutrient.

9. The package of claim 1 wherein said first portion of said capsule comprises a plastic material having a specific gravity of less than 1.

10. A package for a liquid and a substance which is to be mixed with the liquid prior to use, comprising:

a container for the liquid, said container having a top and a bottom;

an openable capsule containing the substance and situated in said container, said capsule having a first separate portion, which is floatable in the liquid, and a second separate portion, which is fixed to the container adjacent said bottom thereof;

a temperature dependent bonding agent joining said first and second separate portions together to form said capsule in a closed state, said bonding agent effecting bonding at temperatures below a predetermined temperature, and terminating bonding at said predetermined temperatures to allow said separate portions to separate from each other, as the contents of the container are heated to at least said predetermined temperature; and an elongated flexible anchor interconnecting said first and second separate portions and having a length which permits said first separate portion to float upwardly a predetermined distance from said bottom of said container toward said top after separation of said first separate portion from said second separate portion.

11. The package of claim 10 wherein said capsule contains, in addition to said substance, air of sufficient quantity to cause, where expanded by heating of the liquid in said container to said predetermined temperature, instantaneous separation of said first and second portions and intimate mixing of said substance and said liquid.

12. The package of claim 10 wherein said substances comprises a flavorant or a nutrient.

13. The package of claim 10 wherein said first portion of said capsule comprises a plastic material having a specific gravity of less than 1.

14. A package for a liquid and a substance which is to be mixed with the liquid prior to use, comprising:

a container for the liquid, said container having an inner surface;

an openable capsule containing the substance and situated in the container, said capsule having a first separate portion and a second separate portion;

a temperature dependent bonding agent joining said first and second separate portions together to form said capsule in a closed state, said bonding agent effecting bonding at temperatures below a predetermined temperature, and terminating bonding at said predetermined temperature to allow said first and second portions to separate completely from each other and releases the substance from said capsule into the liquid in said container, as the contents of said container are heated to at least said predetermined temperature; and said separate portions of said capsule abutting, under at least some bias, said inner surface of said container at two opposite locations when in said closed state.

15. The package of claim 14 wherein said capsule contains, in addition to said substance, air of sufficient quantity to cause, where expanded by heating of the liquid in said container to said predetermined temperature, instantaneous separation of said first and second portions and intimate mixing of said substance and said liquid.

16. The package of claim 14 wherein said first separate portion and said second separate portion, respectively, of said capsule comprise a first semi-cylindrical tray and a second semi-cylindrical tray, respectively, each tray having a flange extending continuously around said tray, said flanges of said first and second trays abutting each other and being sealed together by said bonding agent.

17. The package of claim 16 wherein a plane wing protrudes from each of said flanges and abuts against said inner surface of said container.

18. The package of claim 17 wherein each of said flanges is planar, and each wing of each flange forms an angle to its respective flange.

19. The package of claim 14 wherein said first separate portion of the capsule comprises a semi-cylindrical tray and said second separate portion of said capsule comprises an essentially flat disc which is sealingly secured to said tray by said bonding agent; and wherein flat disc has an extension from the tray in the form of a resilient wing.

20. The package of claim 14 wherein said capsule is made of a plastics material having a specific gravity of less than 1.

* * * * *